US005813047A

United States Patent [19]

Teichroeb

[11] Patent Number: 5,813,047

[45] Date of Patent: Sep. 29, 1998

[54] TOILET FLUSHING SYSTEM THAT ALLOWS USE OF GRAY WATER DRAINED FROM A SINK

[76] Inventor: Darrick Teichroeb, R.R. #3 Noble Road, Armstrong, BC, Canada, V0E 1B0

[21] Appl. No.: 799,500

[22] Filed: Feb. 12, 1997

[51] Int. Cl.[6] ..... E03C 1/01

[52] U.S. Cl. ..... 4/665; 4/364

[58] Field of Search ..... 4/327, 363, 364, 4/389, 390, 397, 400, 665

[56] References Cited

U.S. PATENT DOCUMENTS

| | | | |
|---|---|---|---|
| 933,409 | 9/1909 | Williams | 4/364 |
| 4,120,055 | 10/1978 | Mormile | 4/366 X |
| 5,317,766 | 6/1994 | McDonald et al. | 4/665 |

FOREIGN PATENT DOCUMENTS

| | | | |
|---|---|---|---|
| 0000445 | of 1853 | United Kingdom | 4/363 |
| 2087943 | 6/1982 | United Kingdom | 4/665 |

*Primary Examiner*—Robert M. Fetsuga

[57] ABSTRACT

A toilet flushing system that allows use of gray water drained from a sink including a toilet having a bowl, a water tank having a lower drain hole and an inner wall defining an upper compartment and a lower compartment and with the inner wall further having an upper drain hole; a sink having a drain pipe extended within the upper compartment; a connecting channel extended between the bowl and the lower drain hole; a flush tube inserted within the upper drain hole and having an upper end with perforations formed thereon and a lower closed plug end; a flushing mechanism having one orientation for permitting the flush tube to be positioned at a location that allows flow of water from the upper compartment to the lower compartment through the perforations thereof and further prevents flow of water into the connecting channel, the flushing mechanism further having another orientation that prevents flow of water from the upper compartment to the lower compartment and further permits water to flow into the connecting channel and to the bowl for flushing.

2 Claims, 3 Drawing Sheets

FIG 1
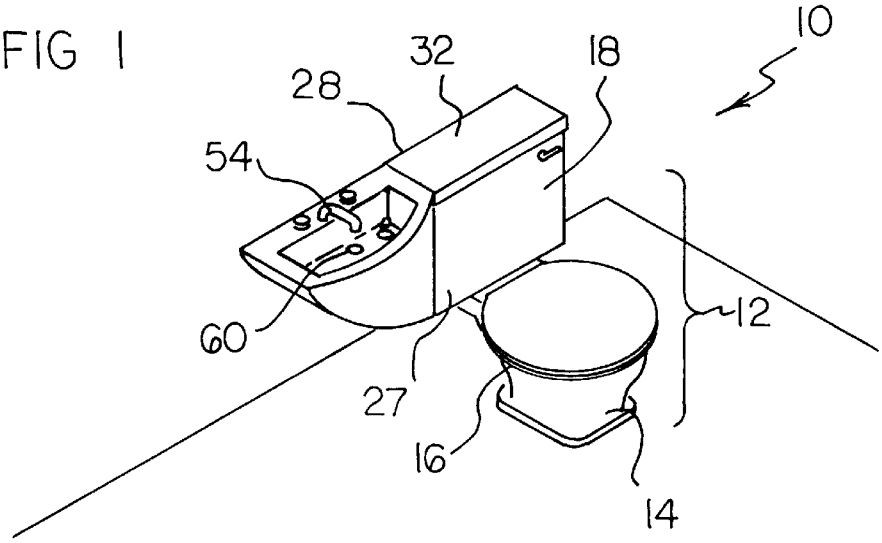
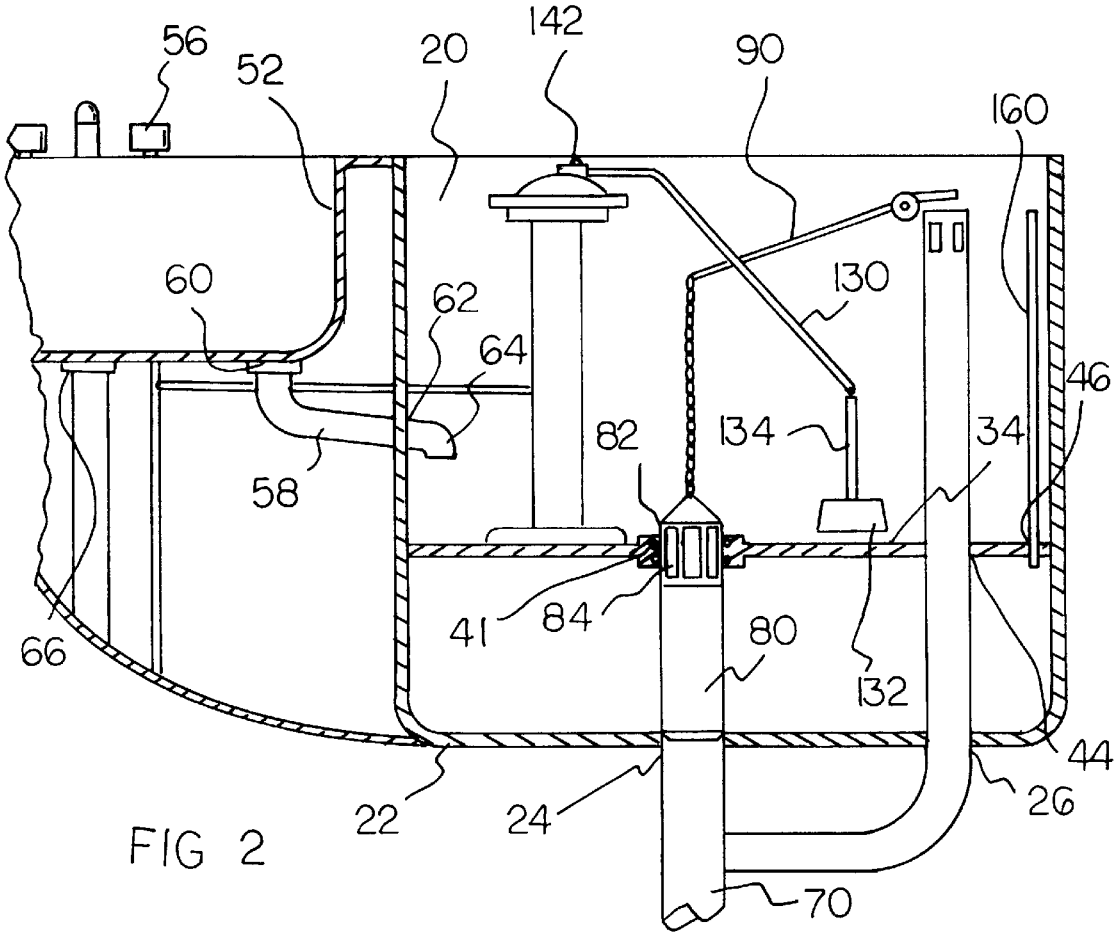
FIG 2

TOILET FLUSHING SYSTEM THAT ALLOWS USE OF GRAY WATER DRAINED FROM A SINK

BACKGROUND OF THE INVENTION

1. Field of the Invention

The present invention relates to a toilet flushing system that allows use of gray water drained from a sink and more particularly pertains to flushing with a toilet flushing system that uses gray water drained from a sink.

2. Description of the Prior Art

The use of flushing systems is known in the prior art. More specifically, flushing systems heretofore devised and utilized for the purpose of allowing the use of gray water for flushing a toilet are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,453,665 to Cokie et al. discloses a portable toilet sink unit. U.S. Pat. No. 3,579,655 to Sundberg discloses portable toilet and sink structures and the like. U.S. Pat. No. 5,228,152 to Fraley discloses a water saving toilet and bathroom fixture system. U.S. Pat. No. 5,243,719 to McDonald et al. discloses a gray water recycle system. U.S. Pat. No. 5,274,856 to Bernard et al. discloses a portable hygienic apparatus. U.S. Pat. No. 5,317,766 to McDonald et al. discloses a gray water recycle system.

While these devices fulfill their respective, particular objective and requirements, the aforementioned patents do not describe a toilet flushing system that allows gray water drained from a sink to be put to use in flushing a toilet.

In this respect, the toilet flushing system that allows use of gray water drained from a sink according to the present invention substantially departs from the conventional concepts and designs of the prior art, and in doing so provides an apparatus primarily developed for the purpose of flushing.

Therefore, it can be appreciated that there exists a continuing need for new and improved toilet flushing system that allows use of gray water drained from a sink which can be used for flushing. In this regard, the present invention substantially fulfills this need.

SUMMARY OF THE INVENTION

In the view of the foregoing disadvantages inherent in the known types of flushing systems now present in the prior art, the present invention provides an improved toilet flushing system that allows use of gray water drained from a sink. As such, the general purpose of the present invention, which will be described subsequently in greater detail, is to provide a new and improved toilet flushing system that allows use of gray water drained from a sink and method which has all the advantages of the prior art and none of the disadvantages.

To attain this, the present invention essentially comprises, in combination, a toilet having a bowl with a fillable basin, a water tank positioned above the bowl for providing water for flushing and with the tank having a hollow interior bounded by a bottom wall with a lower drain hole and a first bore formed thereon, a periphery extended upwards from the bottom wall to define a top opening and with the periphery formed a long front wall, a long back wall, and a pair of opposed short side walls, a removable lid positionable over the opening for precluding access to the interior, and a substantially horizontal inner wall extended across the interior and coupled to the side walls to define an upper compartment for holding water and a lower compartment for holding water and with the inner wall having an upper drain hole formed thereon and positioned in axial alignment with the lower drain hole, a first bore formed thereon, and a second bore formed thereon.

A sink is provided and has a drain pipe extended angularly downwards and through an access hole formed on one of the short walls of the tank. The drain pipe is terminated at an outlet end positioned within the upper compartment of the tank at a location offset a distance above the inner wall. The drain pipe is used for delivering gray water for filling the compartments of the tank. A connecting channel is also provided. The connecting channel is extended through the bowl and has a lower end in communication with the basin and an upper end in communication with the lower drain hole of the tank. The connecting channel thereby places the interior of the tank in communication with the basin of the bowl. The sink further has a second drain pipe extended vertically downward and connected to a conventional sewer.

An elongated flush tube is included and disposed within the tank. The flush tube is removably slidably inserted within the upper drain hole. The flush tube has an upper end with a plurality of perforations formed therearound and a lower closed plug end. A flushing assembly is provided and includes a rotatable handle extended outwards from the front wall of the tank, a chain having an upper end and a lower end and with the lower end thereof coupled to the upper end of the flush tube, and an elongated shaft having one end coupled to the upper end of the chain and another end coupled to the handle. The handle has a released orientation that permits the upper end of the flush tube to be positioned at a location that allows flow of water from the upper compartment to the lower compartment of the tank through the perforations thereof and further permits the plug end of the flush tube to be positioned within the lower drain hole to prevent water from flowing into the connecting channel. The handle further having a depressed orientation that permits the upper end of the flush tube to be positioned at a location that prevents flow of water from the upper compartment to the lower compartment of the tank and further permits the plug end of the flush tube to be positioned away from the lower drain hole to allow water to flow into the connecting channel and to the bowl for flushing.

An upstanding support post is included and has a lower end and an upper end and with the lower end coupled to the inner wall. A water supply valve is included and secured to the upper end of the post. The water supply valve is further securable to an external water supply line for supplying a source of supplemental water for filling the tank. A flush controller assembly is provided and includes a float positioned within the upper compartment, a shaft having a lower end coupled to the float and an upper end, and a lever having one end pivotally coupled to the upper end of the shaft and another end coupled to the water supply valve. Lowering of the float opens the water supply valve for filling the tank with supplemental water. Raising of the float closes the water supply valve and prevents the tank from being filled with supplemental water. The water supply valve is fully closed when the upper compartment is partially filled with water. An overflow tube is included and disposed within the first bore of the inner wall and the first bore of the bottom wall of the tank. The overflow tube has an open lower end coupled to the connecting channel and an upper perforated end extended to a location above a preset level and below the water supply valve. Water that rises to a level above the present level is drained through the perforations of the overflow tube to the bowl. Lastly, an air vent tube is disposed within the second bore of the inner wall. The air vent tube has an open lower end situated within the lower compartment adjacent the inner wall and an open upper end situated within the upper compartment adjacent the top opening. By this design, air is allowed to pass between the upper compartment and the lower compartment during the filling and the emptying of the lower compartment. As such, water moves without impedance resulting from a potential vacuum.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved toilet flushing system that allows use of gray water drained from a sink which has all the advantages of the prior art flushing systems and none of the disadvantages.

It is another object of the present invention to provide a new and improved toilet flushing system that allows use of gray water drained from a sink which may be easily and efficiently manufactured and marketed.

It is a further object of the present invention to provide a new and improved toilet flushing system that allows use of gray water drained from a sink which is of a durable and reliable construction.

An even further object of the present invention is to provide a new and improved toilet flushing system that allows use of gray water drained from a sink which is susceptible of a low cost of manufacture with regard to both materials and labor, and which accordingly is then susceptible of low prices of sale to the consuming public, thereby making such toilet flushing system that allows use of gray water drained from a sink economically available to the buying public.

Still yet another object of the present invention is to provide a new and improved toilet flushing system that allows use of gray water drained from a sink which provides in the apparatuses and methods of the prior art some of the advantages thereof, while simultaneously overcoming some of the disadvantages normally associated therewith.

Still another object of the present invention is to flush with a toilet flushing system that uses gray water drained from a sink.

Lastly, it is an object of the present invention to provide a new and improved toilet flushing system that allows use of gray water drained from a sink including a toilet having a bowl, a water tank having a lower drain hole and an inner wall defining an upper compartment and a lower compartment and with the inner wall further having an upper drain hole; a sink having a drain pipe extended within the upper compartment; a connecting channel extended between the bowl and the lower drain hole; a flush tube inserted within the upper drain hole and having an upper end with perforations formed thereon and a lower closed plug end; a flushing mechanism having one orientation for permitting the flush tube to be positioned at a location that allows flow of water from the upper compartment to the lower compartment through the perforations thereof and further prevents flow of water into the connecting channel, the flushing mechanism further having another orientation that prevents flow of water from the upper compartment to the lower compartment and further permits water to flow into the connecting channel and to the bowl for flushing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment constructed in accordance with the principles of the present invention.

FIG. 2 is a cross-sectional view of the present invention in a mode ready for flushing.

Similar reference characters refer to similar parts throughout the several views of the drawings.

DESCRIPTION OF THE PREFERRED EMBODIMENT

Figure 3:
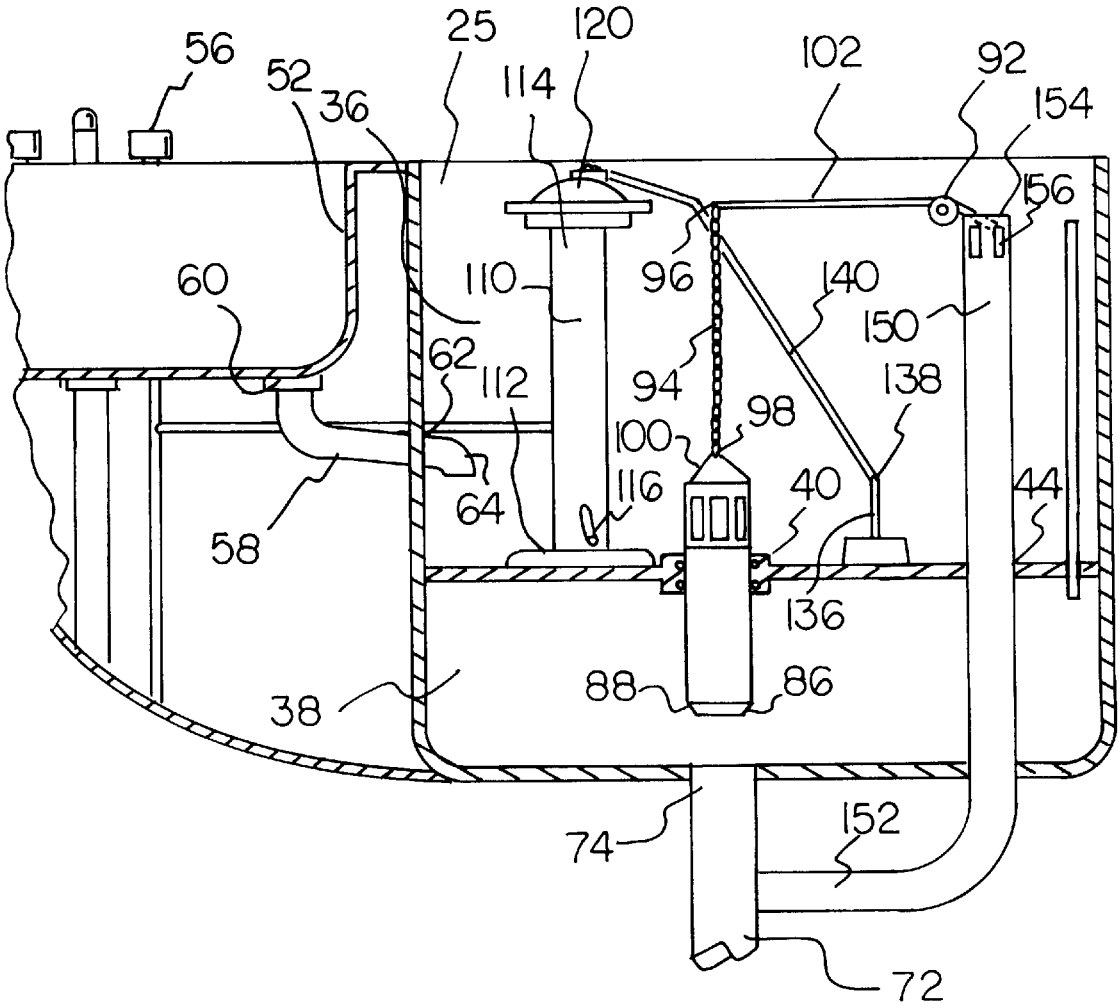
FIG. 3 is another cross-sectional view of the present invention when being flushed.

With reference now to the drawings, and in particular, to FIG. 1 thereof, the preferred embodiment of the new and improved toilet flushing system that allows use of gray water drained from a sink embodying the principles and concepts of the present invention and generally designated by the reference number 10 will be described.

The preferred embodiment of the present invention comprises a plurality of components. In their broadest context, such components include a toilet with flushing and flushing controlling assembly, and a sink. Such components are individually configured and correlated with respect to each other to provide a structure that allows use of gray water drained from the sink for flushing the toilet.

Specifically, the present invention includes a toilet 12. The toilet is formed of porcelain or other suitable rigid material and includes a bowl 14 with a fillable concave basin 16. A water tank 18 is coupled to and positioned above the bowl 14 for providing water to the bowl for flushing. The bowl is further secured to an external sewage system (not pictured). The tank has a hollow interior 20 bounded by a bottom wall 22 with a lower drain hole 24 formed thereon and a first bore 26 formed thereon. A periphery is extended upwards from the bottom wall 22 and defines a top opening 25 for allowing access to the tank for servicing. The periphery is formed of a long front wall 27, a long back wall 28, and a pair of opposed short side walls 30. A removable and generally rectangular lid 32 is positionable over the opening for precluding access to the interior. In addition, a substantially horizontal planar inner wall 34 is extended across the interior and coupled to the side walls and the front and back walls to define an upper compartment 36 for holding water for flushing and a lower compartment 38 for holding water for flushing. The inner wall has an upper drain hole 40 formed thereon and positioned in axial alignment with the lower drain hole 24. For reasons that will become apparent later, a pair of vertically spaced O-rings 41 are situated about the periphery of the upper drain hole 40. The drain holes are of equal size. In addition, a first bore 44 and a second bore 46 are formed in the inner wall.

A sink 50 is also included. The sink has a concave basin 52 and a faucet 54 extended over the basin and controlled with a handle 56. The sink is supported in a generally level orientation for use by a table 57 with a backslash area. The sink includes a drain pipe 58 extended angularly downwards from a drain hole 60 and through an access hole 62 formed on one of the short walls 30 of the tank. The drain pipe is terminated at a curved outlet end 64 that is positioned within the upper compartment 36 of the tank at a location offset a distance above the inner wall 34. The drain pipe is used for delivery gray water from the sink for filling the compartments 36, 38 of the tank. The sink further has a second drain pipe 66 extended vertically downward and connected to a conventional sewer. By equipping the sink with a second drain pipe, a user is afforded the ability to utilize the gray water as toilet water in a selective manner.

A connecting channel 70 is extended through a rearward extent of the bowl 14. The connecting channel has a lower end 72 coupled to and placed in communication with the basin 16 of the toilet and an upper end 74 coupled to and placed in communication with the lower drain hole 24 of the tank. The connecting channel 70 thereby places the interior of the tank in communication with the basin 16 of the bowl.

An elongated rigid plastic flush tube 80 is disposed within the tank 18 and slidably inserted within the upper drain hole 40 between the O-rings 41. It should be noted that the O-rings maintain the flush tube in a proper vertical alignment when sliding within the upper drain hole 40. The flush tube has an upper end 82 with a plurality of rectangular perforations 84 formed therearound. The flush tube also has a closed lower plug end 86 with a rubber seal 88 affixed therearound.

A flushing assembly 90 is included for allowing the toilet to be flushed. The flushing assembly includes a rotatable rigid metal handle 92 extended outwards from the front wall 27 of the tank. A metal chain 94 formed of a plurality of interconnected links is included. The chain 94 has an upper end 96 and a lower end 98. The lower end 98 of the chain is coupled to the upper end 82 of the flush tube with a loop 100 of metal wire. The flushing mechanism also includes an elongated rigid metal shaft 102. The shaft has one end coupled to the upper end 96 of the chain and another end coupled to the handle 92. The handle has a released orientation that permits the upper end 82 of the flush tube to be positioned at a location that allows flow of water from the upper compartment 36 to the lower compartment 38 of the tank through the perforations 84. Furthermore, when the handle is released, the flushing assembly further permits the plug end 86 of the flush tube to be snugly positioned within the lower drain hole 24 with the seal 88 to prevent water from flowing into the connecting channel 70 as shown in FIG. 2. To prevent water from flowing into the connecting channel 70 from the upper compartment, it is imperative that the lower end of the flush tube be closed. The handle 92 further has a depressed orientation that permits the upper end 82 of the flush tube to be positioned at a location that prevents flow of water from the upper compartment 36 to the lower compartment 38 of the tank. It should be noted that the O-rings 41 facilitate the prevention of water leakage through the upper drain hole when the upper drain hole is elevated. In addition, when the handle is depressed, the flushing assembly further permits the plug end 86 of the flush tube to be positioned out of the lower drain hole 24 to allow water from the lower compartment to flow into the connecting channel 70 and to the bowl 14 for flushing.

An upstanding rigid plastic support post 110 is included. The support post has a lower end 112 and an upper end 114. The lower end is coupled to the inner wall 34. The end 114 of the support post is a water supply valve 120. Secured to the upper water supply valve is further securable to an external water supply line 116. The water supply valve is used for supplying a source of supplemental water for filling the tank 18. The supplemental water is used for filling the tank when only a small amount of gray water has been supplied from the sink.

The toilet also includes a flush controller assembly 130. The flush controller assembly includes a float 132. The float is positioned within the upper compartment 36. The float is buoyed upon the surface of water that is disposed within the upper compartment. A vertical rigid shaft 134 has a lower end 136 coupled to the float and an upper end 138. The flush controller assembly includes a generally rigid lever 140 having one end pivotally coupled to the upper end 138 of the shaft with a pin and another end coupled to the water supply valve 120 through the use of an adjustment screw 142. Lowering of the float 132 opens the water supply valve 120 for filling the tank with water. The raising of the float closes the water supply valve for preventing the tank from being filled with water. The water supply valve is fully closed when the upper compartment 38 is filled with water.

An overflow tube 150 is disposed within the first bore 44 of the inner wall and the first bore 26 of the bottom wall of the tank. The overflow tube has an open lower end 152 coupled to the connecting channel 70. The overflow tube also has an upper end with perforations 156 formed thereon. The upper end is extended to a location offset just above a preset level and below the water supply valve 120. If due to failure of the water supply valve the water rises to a level above the preset level, excess water is drained through the perforations of the overflow tube and to the bowl 14, thereby preventing the tank from overflowing.

Lastly, an air vent tube 160 is disposed within the second bore 46 of the inner wall. The air vent tube 160 has an open lower end situated within the lower compartment adjacent the inner wall and an open upper end situated within the upper compartment adjacent the top opening. By this design, air is allowed to pass between the upper compartment and the lower compartment during the filling and the emptying of the lower compartment. As such, water moves without impedance which would result from the forming of a vacuum.

Figure 4:
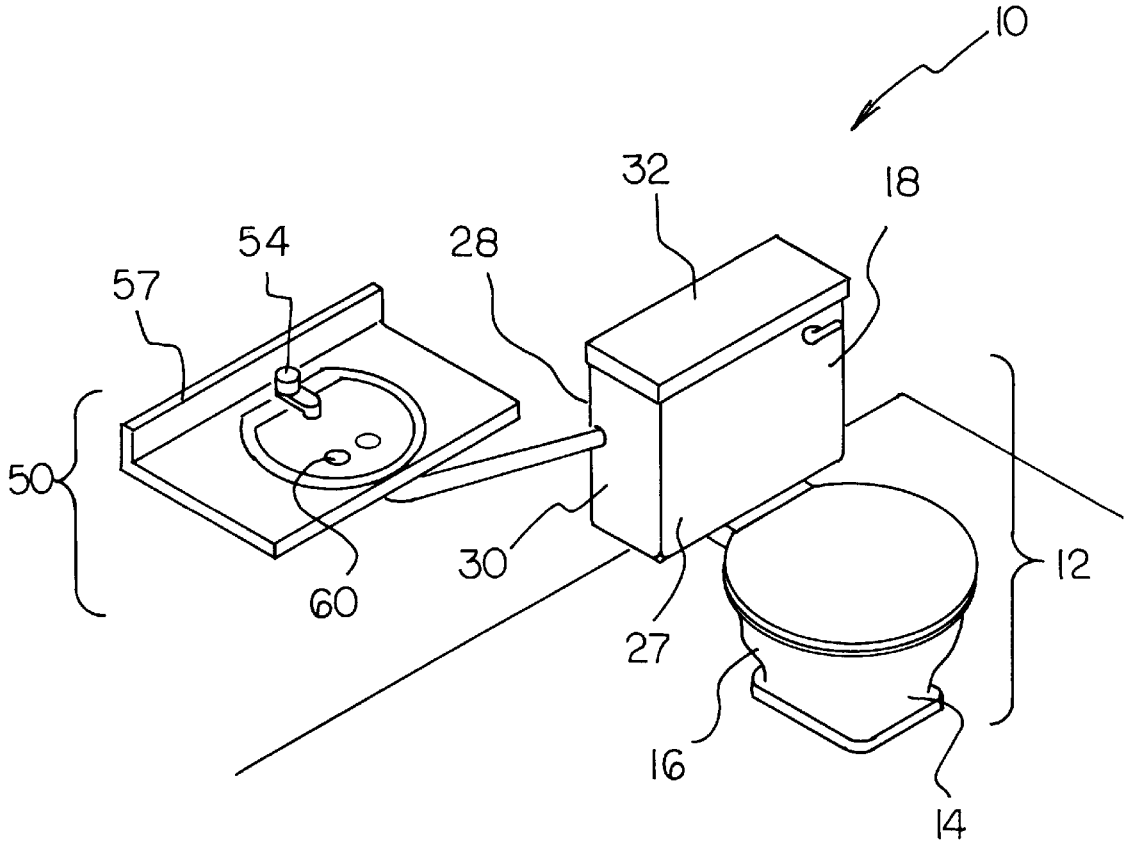
FIG. 4 is a perspective view of an alternate embodiment constructed in accordance with the principles of the present invention.

An alternate embodiment of the invention is illustrated in FIG. 4. In such embodiment, the sink and toilet are separated one from another. For certain bathroom layouts, this is either necessary or preferred. This is in contrast to the primary embodiment wherein the sink and toilet are in physical contact, one with respect to the other, side by side. This gives an appearance of a unitary fixture with an upper surface at a common height for functioning as a common upper surface. The internal operating components of both embodiments are the same except for the length of the sink drain pipe connected to the toilet which is longer in the second embodiment to accommodate the desired distance between the fixtures being coupled.

The present invention includes a sink and toilet that are provided in a one piece configuration. Water drains directly from the sink directly into the basin of the toilet. The capacity of the upper cavity of the tank is about five gallons. The sink must sit high enough so that water can drain into the reservoir. The tank has the ability to maintain at least one flush capacity. A simple overflow pipe in the tank is provided so that if the water level becomes too high, water can simply run into the overflow pipe and down into the bowl of toilet, thus bypassing the flushing system.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A toilet flushing system that allows use of gray water drained from a sink comprising:

a toilet having a bowl with a basin, a water tank for providing water for flushing and with the tank having a hollow interior, a bottom wall with a lower drain hole, a periphery extended upwards from the bottom wall to define a top opening, and an inner wall extended across the interior and coupled to the periphery to define an upper compartment and a lower compartment and with the inner wall having an upper drain hole formed thereon and positioned in axial alignment with the lower drain hole;

a sink having a drain pipe extended within the upper compartment of the tank, the sink further having a second drain pipe extended vertically downwards and connected to a conventional sewer;

a connecting channel extended through the bowl and having a lower end in communication with the basin and an upper end in communication with the lower drain hole;

an elongated flush tube slidably inserted within the upper drain hole and with the flush tube having an upper end with a plurality of perforations formed thereon and a lower closed plug end;

flushing assembly having one orientation for permitting the flush tube to be positioned at a location that allows flow of water from the upper compartment to the lower compartment through the perforations thereof and further prevents flow of water into the connecting channel, the flushing assembly further having another orientation that prevents flow of water from the upper compartment to the lower compartment and further permits water to flow into the connecting channel and to the bowl for flushing; and an overflow tube disposed within an associated bore of the inner wall and another bore of the bottom wall of the tank, the overflow tube having an open lower end coupled to the connecting channel and an upper perforated end extended to a location above a preset level and below a water supply valve and with water that rises to a level above the preset level draining through the perforations of the overflow tube to the bowl.

2. A toilet flushing system that allows use of gray water drained from a sink for flushing comprising, in combination:

a toilet having a bowl with a fillable basin, a water tank positioned above the bowl for providing water for flushing and with the tank having a hollow interior bounded by a bottom wall with a lower drain hole and a first bore formed thereon, a periphery extended upwards from the bottom wall to define a top opening and with the periphery formed a long front wall, a long back wall, and a pair of opposed short side walls, a removable lid positionable over the opening for precluding access to the interior, and a substantially horizontal inner wall extended across the interior and coupled to the side walls to define an upper compartment for holding water and a lower compartment for holding water and with the inner wall having an upper drain hole formed thereon and positioned in axial alignment with the lower drain hole, a first bore formed thereon and a second bore formed thereon, wherein the upper drain hole has a pair of vertically spaced O-rings situated about the periphery thereof;

a sink having a drain pipe extended angularly downwards and through an access hole formed on one of the short walls of the tank and with the drain pipe terminated at an outlet end positioned within the upper compartment of the tank at a location offset a distance above the inner wall and with the drain pipe used for delivering gray water for filling the compartments of the tank, the sink further having a second drain pipe extended vertically downward and connected to a conventional sewer;

a connecting channel extended through the bowl and having a lower end in communication with the basin and an upper end in communication with the lower drain hole of the tank and with the connecting channel thereby placing the interior of the tank in communication with the basin of the bowl;

an elongated flush tube disposed within the tank and slidably inserted within the upper drain hole and with the flush tube having an upper end with a plurality of perforations formed therearound and a lower closed plug end;

a flushing assembly including a rotatable handle extended outwards from the front wall of the tank, a chain having an upper end and a lower end and with the lower end thereof coupled to the upper end of the flush tube, and an elongated shaft having one end coupled to the upper end of the chain and another end coupled to the handle, the handle having a released orientation that permits the upper end of the flush tube to be positioned at a location that allows flow of water from the upper compartment to the lower compartment of the tank through the perforations thereof and further permits the plug end of the flush tube to be positioned within the lower drain hole to prevent water from flowing into the connecting channel, the handle further having a depressed orientation that permits the upper end of the flush tube to be positioned at a location that prevents flow of water from the upper compartment to the lower compartment of the tank and further permits the plug end of the flush tube to be positioned away from the lower drain hole to allow water to flow into the connecting channel and to the bowl for flushing;

an upstanding support post having a lower end and an upper end and with the lower end coupled to the inner wall;

a water supply valve secured to the upper end of the post and securable to an external water supply line for supplying a source of supplemental water for filling the tank;

a flush controller assembly including a float positioned within the upper compartment, a shaft having a lower end coupled to the float and an upper end extended within the upper compartment, and a lever having one end pivotally coupled to the upper end of the shaft and another end coupled to the water supply valve with lowering of the float opening the water supply valve for filling the tank with water and with raising of the float closing water supply valve for preventing the tank from being filled with water, and with the water supply valve being fully closed when the upper compartment is filled with water;

an overflow tube disposed within the first bore of the inner wall and the first bore of the bottom wall of the tank, the overflow tube having an open lower end coupled to the connecting channel and an upper perforated end extended to a location above a preset level and below the water supply valve and with water that rises to a level above the preset level draining through the perforations of the overflow tube to the bowl; and an air vent tube disposed within the second bore of the inner wall, the air vent tube having an open lower end situated within the lower compartment adjacent the inner wall and an open upper end situated within the upper compartment adjacent the top opening for allowing air to pass between the upper compartment and the lower compartment during the filling and the emptying of the lower compartment.

* * * * *